US005461466A

United States Patent [19]

Girard et al.

[11] Patent Number: 5,461,466

[45] Date of Patent: Oct. 24, 1995

[54] DRIPLESS SEAL FOR A LIQUID TONER CARTRIDGE

[75] Inventors: James J. Girard, Boise; David L. Smith, Meridian, both of Id.

[73] Assignee: Hewlett-Packard Company, Palo Alto, Calif.

[21] Appl. No.: 236,949

[22] Filed: May 2, 1994

[51] Int. Cl.[6] ..... G03G 15/10

[52] U.S. Cl. ..... 355/256; 354/324; 355/200

[58] Field of Search ..... 355/200, 256, 355/260; 354/323, 324

[56] References Cited

U.S. PATENT DOCUMENTS

| | | | |
|---|---|---|---|
| 3,641,907 | 2/1972 | Cranskens et al. | 355/256 X |
| 4,181,094 | 1/1980 | Gardiner | 355/256 X |
| 4,503,625 | 3/1985 | Manzer | 354/324 X |
| 4,518,240 | 5/1985 | Taylor et al. | 354/324 X |
| 4,958,666 | 9/1990 | Kocourek et al. | 354/324 X |
| 5,396,316 | 3/1995 | Smith | 355/256 |

*Primary Examiner*—Fred L. Braun

[57] ABSTRACT

A container for holding liquid in its interior includes an aperture which provides access to the interior of the container. A valve has an open position and a closed position, is mounted in the aperture and mates with an actuator when the container is inserted into a print mechanism. The actuator causes the valve to transition from the closed position to an open position and vice-versa. A seal member is rotatably mounted in the aperture and includes a pathway for receiving the actuator. The pathway is normally positioned non-aligned with the aperture so as to render the valve non-accessable from outside the container. A control mechanism is coupled to the seal member and rotatably moves the seal member to reposition the pathway into alignment with the aperture so as to be in position to receive the actuator. The control mechanism is actuated when the container is inserted into the print mechanism.

7 Claims, 2 Drawing Sheets

DRIPLESS SEAL FOR A LIQUID TONER CARTRIDGE

FIELD OF THE INVENTION

This invention relates to electrophotographic(EP) printing and, more particularly, to a user-replaceable liquid toner cartridge for an EP printer.

BACKGROUND OF THE INVENTION

To maintain costs as low as possible, EP printers are now designed to allow as much user maintenance as possible. To this end, dry toner EP printers enable a user to replace an exhausted toner cartridge with a new toner cartridge which also contains an entirely new organic photoconductor-coated drum and related actuating mechanisms. EP printers which employ liquid toners are provided with refillable toner reservoirs, thus requiring the user to replenish the inprinter reservoir from a liquid toner supply. The user is thus exposed to possible spillage, vapors, and with color printers, the possibility that a wrong color toner will be loaded into a reservoir.

In copending U.S. patent application, Ser. No. 08/139,956, filed Oct. 20, 1993, now U.S. Pat. No. 5,396,316, (Attorney docket no. 1093459-1), entitled "User-Replaceable Liquid Toner Cartridge With Integral Pump And Valve Mechanisms", a replaceable toner cartridge is described which includes an integral pump connected to a toner supply reservoir and a mechanical coupling that automatically receives a pump actuator when the liquid toner cartridge is inserted into an EP printer. The disclosed liquid toner cartridge structure enables replacement of the pump each time the liquid toner cartridge is replaced, thereby replacing a failure-prone part and providing for more reliable operation of the EP printer. A further valve is connected to an output from the pump and communicates with an external wall of the toner cartridge where it connects to a fluid fitting in the receptacle in the EP printer. The fluid fitting automatically operates the valve in the cartridge and enables liquid toner flow from the cartridge's reservoir into the receptacle's fluid fitting. Even though the fitting is a "dripless" coupling, its external surface is liquid-toner coated when the cartridge is removed from the EP printer. Such toner can stain a user's hands and/or clothing and requires a level of care in handling which many customers are not willing to exert.

The prior art has attempted to solve the toner contamination problem by incorporating a door/shutter arrangement into a coupling surface of a replaceable toner cartridge. Such an arrangement enables a user with finger pressure, to open the door-shutter and to access the toner-stained portion of the cartridge's fluid coupling.

Accordingly, it is an object of this invention to provide an improved, user-replaceable liquid toner cartridge.

It is another object of this invention to provide an improved, user-replaceable liquid toner cartridge with a mechanism which prevents liquid toner from being present on an external surface of the cartridge when it is being handled by a user.

It is still another object of this invention to provide a user-replaceable toner cartridge that includes a means for sealing a toner access valve, the means for sealing being inexpensive and positioned in a wall of the cartridge.

SUMMARY OF THE INVENTION

A container for holding liquid in its interior comprises an aperture which provides access to the interior of the container. A valve has an open position and a closed position, is mounted in the aperture and mates with an actuator when the container is inserted into a print mechanism. The actuator causes the valve to transition from the closed position to an open position and vice-versa. A seal member is rotatably mounted in the aperture and includes a pathway for receiving the actuator. The pathway is normally positioned non-aligned with the aperture so as to render the valve non-accessible inside the container. A control mechanism is coupled to the seal member and rotatably moves the seal member to reposition the pathway into a alignment with the aperture so as to be in position to receive the actuating means. The control mechanism is actuated when the container is inserted into the print mechanism.

DETAILED DESCRIPTION OF THE INVENTION

Figure 1:
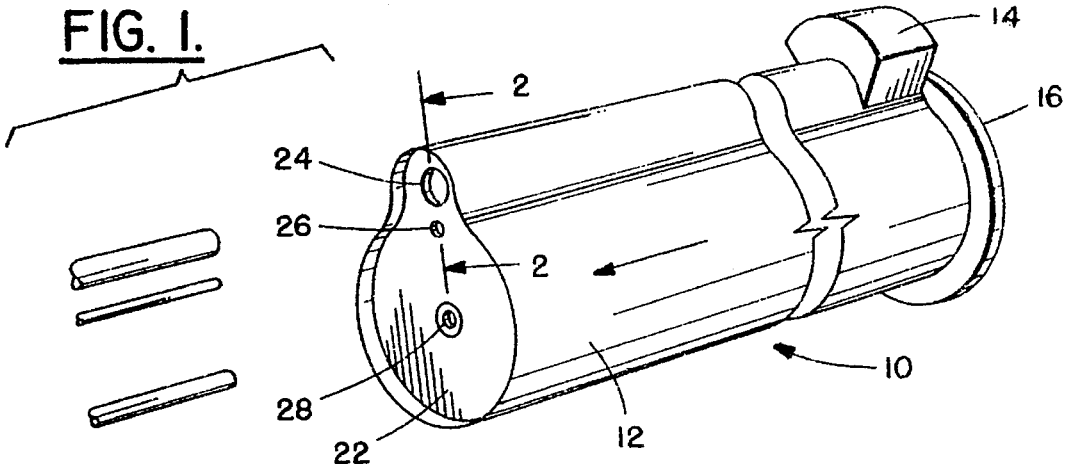
FIG. 1 is a perspective view of a liquid toner container which incorporates the invention hereof.

In FIG. 1, liquid toner cartridge 10 comprises an outer casing 12 into which is molded an alignment extension 14 and an end plate 16. Outer casing 12 is preferably comprised of an appropriate rigid plastic material which provides structural rigidity to liquid toner cartridge 10 and enables normal handling thereof.

Figure 2:
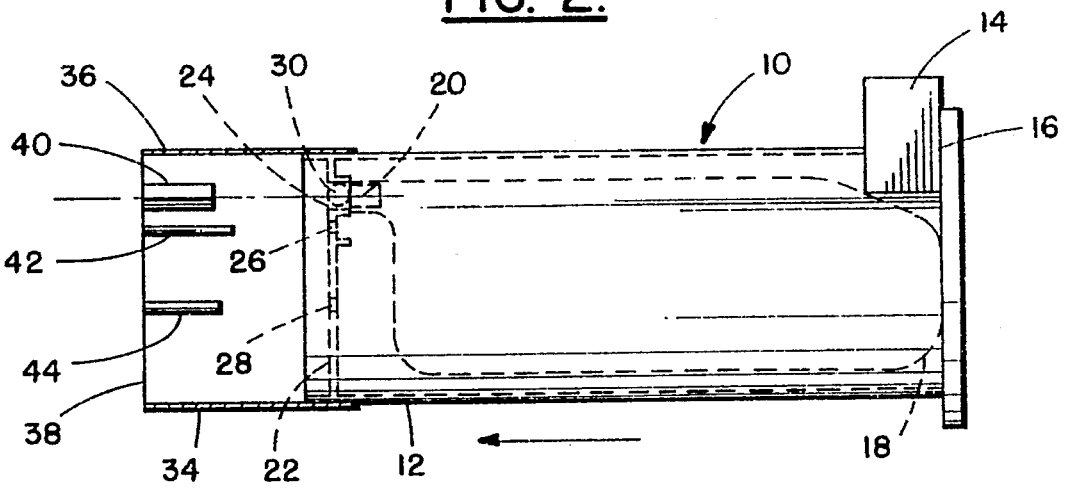
FIG. 2 is a schematic sectional view of the liquid toner container shown in FIG. 1, as it is inserted into an EP printer.

As shown in FIG. 2, the interior volume of liquid toner cartridge 10 includes a flexible plastic bag 18 which holds a supply of liquid toner. Bag 18 is provided with a valve outlet 20 (shown schematically) which is attached to a front wall 22 of liquid toner cartridge 10. Front wall 22 is provided with three apertures, i.e. 24, 26 and 28. Fluid coupling 20 is mounted so as to communicate with aperture 24 and is positioned in the internal volume of toner cartridge 10.

A rotatable seal member 30 is positioned intermediate fluid coupling 20 and the outer surface of wall 22. Seal member 30 is provided with an actuating arm 32 which extends generally downwardly adjacent aperture 26. (Details of seal member 30, aperture 24 and fluid coupling 20 will be described below with respect to FIGS. 3–7.)

Toner cartridge 10 is constructed so as to be insertable into a toner receptacle within an EP printer. Only sidewalls 34, 36 and endwall 38 of the EP toner receptacle are illustrated in FIG. 2. A fluid coupling 40 extends from rear wall 38 and is adapted to engage fluid coupling 20 (through seal 30) when toner cartridge 10 is inserted into the toner receptacle. A member 42 is positioned immediately beneath fluid coupling 40 and mates with aperture 26 to engage arm 32 when toner cartridge 10 is emplaced within the toner receptacle. Arm 32 acts as a control means and causes seal member 30 to open a pathway so that fluid coupling 40 may mate with fluid coupling 20 and act as an actuating means for controlling the open or closed state thereof. A small diameter pipe 44 extends from wall 38 and is connected to a pressurization supply within the EP printer. Pipe 44 mates with aperture 28 and enables pressurization of bag 18 (and the toner contained therein) within toner cartridge 10.

Figure 3:
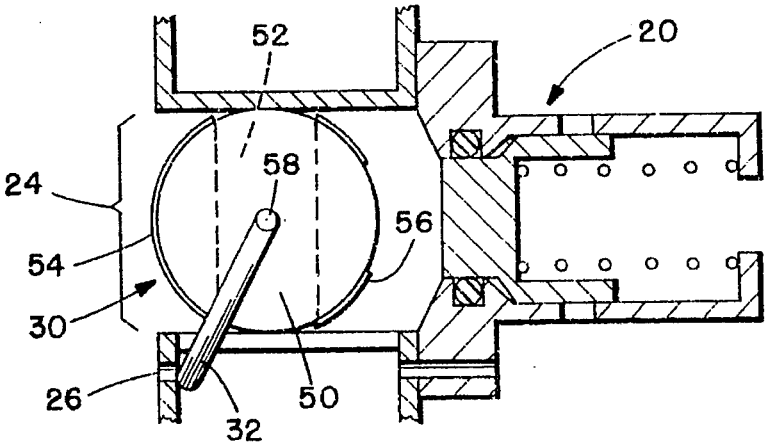
FIG. 3 is a side sectional view showing a seal member in a closed position that is used in the liquid toner cartridge.
Figure 4:
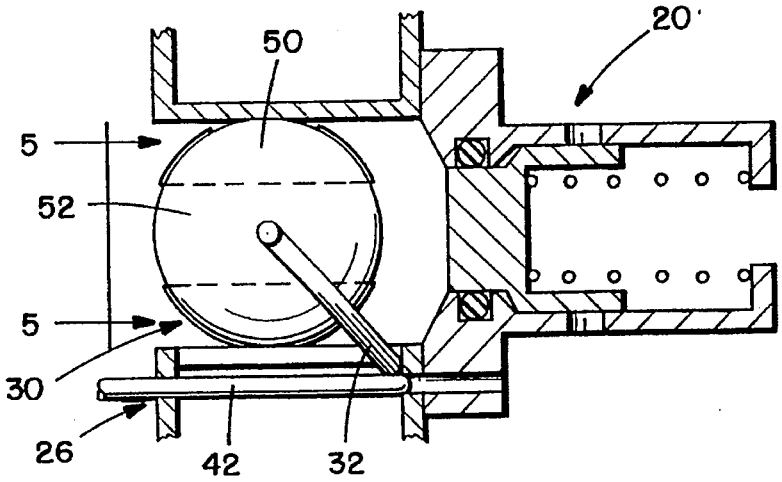
FIG. 4 is a side sectional view showing the seal member of FIG. 3 in an open position.
Figure 5:
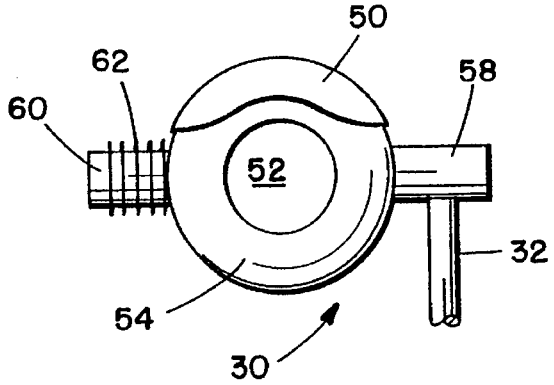
FIG. 5 is a front view of the seal member, removed from the front wall of the toner cartridge of FIG. 2.

Turning to FIGS. 3, 4 and 5, further details of seal member 30 will be described. In a preferred embodiment, seal member 30 comprises an inner foam core 50 which is toner-absorbent. A pathway 52 is formed within the interior of foam core 50 and provides an accessway for fluid coupling 40 (see FIG. 2) to mate with fluid coupling 20 (FIG. 3). An outer hard plastic shell 54 encases foam core 50, except for a portion 56 which abuts a face of fluid coupling 20. In FIG. 3, seal member 30 is shown in a closed position, with pathway 52 vertically oriented and inaccessible through aperture 24. In this configuration, open portion 56 of foam core 50 abuts the face of fluid coupling 20 and is positioned to absorb excess toner which may be present thereon.

FIG. 5 illustrates a front view of seal member 30 as seen along line 5—5 in FIG. 4. Seal member 30 is rotatably mounted on a pair of axles 58, 60. Actuating arm 32 extends downwardly from axle 58 and is rigidly coupled thereto. Axles 58 and 60 mount in apertures (not shown) within wall 22 of liquid toner container 10. Axle 60 includes a spring 62 which spring biases actuating arm 32 towards aperture 26. Spring 62 bias acts to maintain pathway 52 in its "closed" position until toner cartridge 10 is inserted into the toner receptacle. At such time, member 42 enters aperture 26 and causes arm 32 to rotate in a counterclockwise direction. This action causes seal member 30 to rotate in a counterclockwise direction until pathway 52 is aligned with the inner walls of aperture 24.(See FIG. 4). Once the orientation of seal member 30 has been changed to that shown in FIG. 4, further insertion of toner receptacle 10 causes fluid coupling 40 to enter pathway 52 and to engage fluid coupling 20. This action enables a coupling of the toner fluid within bag 18 into the EP printer.

Seal member 30 is preferably spherically shaped (as shown in FIG. 5) so as to snugly fit within a circular aperture 24. While not as preferred, seal member 30 may also be cylindrical in shape, with aperture 24 having a rectangularly shaped opening.

Upon removal of liquid toner cartridge 10 from the toner receptacle, coupling 40 first comes out of engagement with fluid coupling 20. As soon as the end of fluid coupling 40 clears seal member 30, the end of member 42 withdraws through aperture 26, thereby enabling seal member 30 to rotate in a clockwise direction until arm 32 makes contact with the inner surface of the wall which includes aperture 26. At this time, the configuration of seal member 30 returns to that shown in FIG. 3. Any excess fluid that remains on the external face of fluid coupling 20 is absorbed by foam 50. Shell 54 prevents any toner absorbed by foam 50 from being available to touch a user's clothing or hands.

Figure 6:
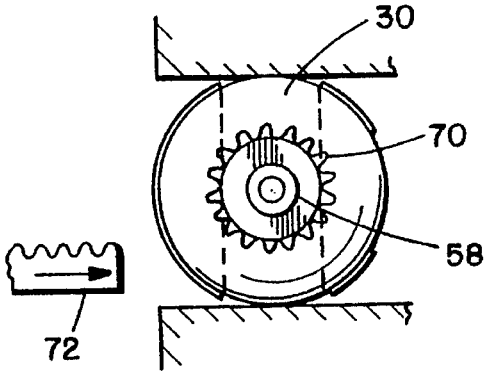
FIG. 6 shows an alternative mechanism for actuating the seal member.

FIG. 6 shows an alternative arrangement for actuating seal member 30. In this case, a gear 70 is mounted on axle 58 and is rotated by a mating linear gear 72 when toner cartridge 10 is inserted into the toner receptacle. Linear gear 72 is designed so as to rotate seal member 30 by 90° when toner cartridge 10 is inserted into the toner receptacle.

Figure 7:
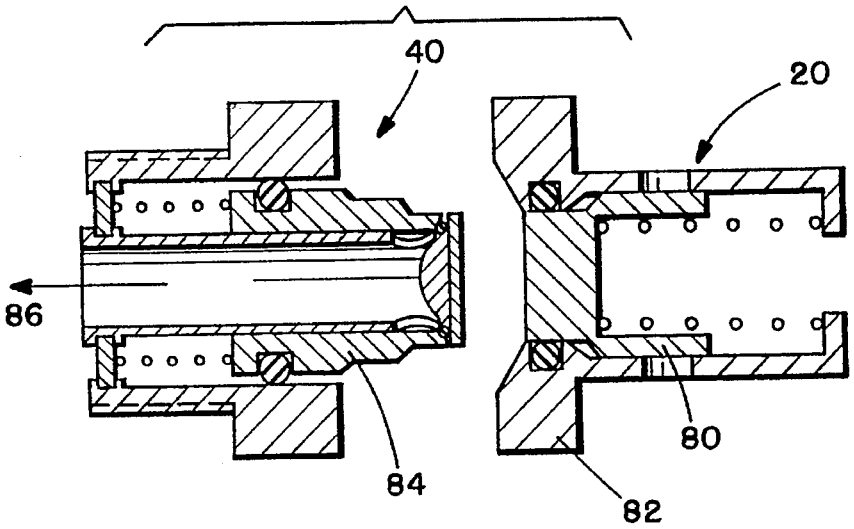
FIG. 7 illustrates a liquid coupling which enables liquid toner to flow from within the liquid toner cartridge and into an EP printer.

FIG. 7 shows a commercially-available fluid coupling that is usable with this invention. Fluid coupling 20 is female and includes a plunger within that is spring biased against casing 82. Male portion 84 is spring biased within coupling 40 and, when engaged with plunger 80, enables fluid flow from coupling 20 into coupling 40 and out through aperture 86.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A container for holding a liquid in its interior and comprising:

an aperture through an outer wall of said container and providing access to said interior;

a valve connected to said aperture, for mating with an actuating means which causes said valve to transition from a closed position to an open position and vice-versa;

a seal member rotatably mounted in said aperture between said outer wall and said valve, said seal member having a pathway for receiving said actuating means, said pathway normally positioned non-aligned with said aperture so as to render said valve inaccessible through said outer wall; and control means coupled to said seal member for rotatably moving said seal member to reposition said pathway into alignment with said aperture so as to be positioned to receive said actuating means, said control means positioned to be actuated by an extended member from a position external to said container.

2. The container as recited in claim 1 wherein said seal member exhibits a circular cross section and is rotatable in a plane of said circular cross section.

3. The container as recited in claim 2 wherein said seal member is spherical in shape and is mounted for rotation in said wall by a pair of axles.

4. The container as recited in claim 1 wherein said seal member is comprised of a material that is absorbent of said liquid.

5. The container as recited in claim 1 wherein said control means is an arm that extends from an axle that mounts said seal member and is actuated by the extended member that is inserted from the exterior to said container.

6. The container as recited in claim 5 wherein said liquid is a liquid toner, and said container is constructed to be insertable into a printer mechanism, said printer mechanism provided with both the extended member for actuating the control means for said seal member and the actuating means for operating said valve.

7. The container as recited in claim 6 wherein said seal member includes a core that is liquid toner absorbent and a circumference of said seal member that is exposed to an area exterior to said container when said pathway is nonaligned with said aperture, is encompassed by a plastic cover to render said liquid toner absorbent core inaccessible to a user.

* * * * *